US008251770B2

(12) United States Patent
Jin et al.

(10) Patent No.: US 8,251,770 B2
(45) Date of Patent: Aug. 28, 2012

(54) SIMULATED EYE FOR TOY

(75) Inventors: Lei Jin, Shenzhen (CN); Kim-Yeung Sip, Shenzhen (CN); Xiong Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 462 days.

(21) Appl. No.: 12/565,708

(22) Filed: Sep. 23, 2009

(65) Prior Publication Data

US 2010/0144240 A1 Jun. 10, 2010

(30) Foreign Application Priority Data

Dec. 8, 2008 (CN) ..... 2008 1 0306049

(51) Int. Cl.
*A63H 3/38* (2006.01)
*A63H 33/26* (2006.01)

(52) U.S. Cl. ..... 446/392; 446/389; 446/131

(58) Field of Classification Search ..... 446/289, 446/392, 129, 131, 137, 139, 89
See application file for complete search history.

(56) References Cited

U.S. PATENT DOCUMENTS

| | | | | |
|---|---|---|---|---|
| 2,853,830 | A * | 9/1958 | Herzog | 446/131 |
| 4,332,039 | A * | 6/1982 | LaFuente | 623/6.64 |
| 6,196,848 | B1 * | 3/2001 | Yamazaki | 434/409 |
| 6,391,057 | B1 * | 5/2002 | Schleipman et al. | 623/6.64 |
| 6,705,874 | B1 * | 3/2004 | Koyama | 434/409 |
| 7,015,892 | B1 * | 3/2006 | Nihira et al. | 345/107 |
| 7,485,025 | B2 * | 2/2009 | Schnuckle | 446/392 |

* cited by examiner

*Primary Examiner* — Gene Kim
*Assistant Examiner* — Alyssa Hylinski
(74) *Attorney, Agent, or Firm* — Altis Law Group, Inc.

(57) ABSTRACT

A simulated eye capable of being changed between a normal and a dilated state. The simulated eye includes an eyeball, a receiving member, at least one first electromagnets, at least one second electromagnets, and magnetic powder. The receiving member includes a translucent portion and a cylindrical portion. The at least one first electromagnets is received in the cylindrical portion and is adjacent to the translucent portion. The at least one second electromagnets is fixed to the cylindrical portion and engages with the translucent portion to close the cylindrical portion to form a closed receiving space. The magnetic powder is received in the closed receiving space. When the first and second electromagnet operates to move the magnetic powder toward and away from the translucent portion, a size of a color area of the translucent portion is changeable, whereby the simulated eye is changed between the normal state and the dilated state.

13 Claims, 7 Drawing Sheets

SIMULATED EYE FOR TOY

BACKGROUND

1. Technical Field

The disclosure relates to toys and, more particularly, to a simulated eye for a toy.

2. Description of Related Art

A typical toy replica of an eye has an eyelid that can open and close. Accordingly, other effects are needed to make the eyes more lifelike.

BRIEF DESCRIPTION OF THE DRAWINGS

The components of the drawings are not necessarily drawn to scale, the emphasis instead being placed upon clearly illustrating the principles of the embodiments of the simulated eye. Moreover, in the drawings, like reference numerals designate corresponding parts throughout several views.

DETAILED DESCRIPTION

Figure 1:
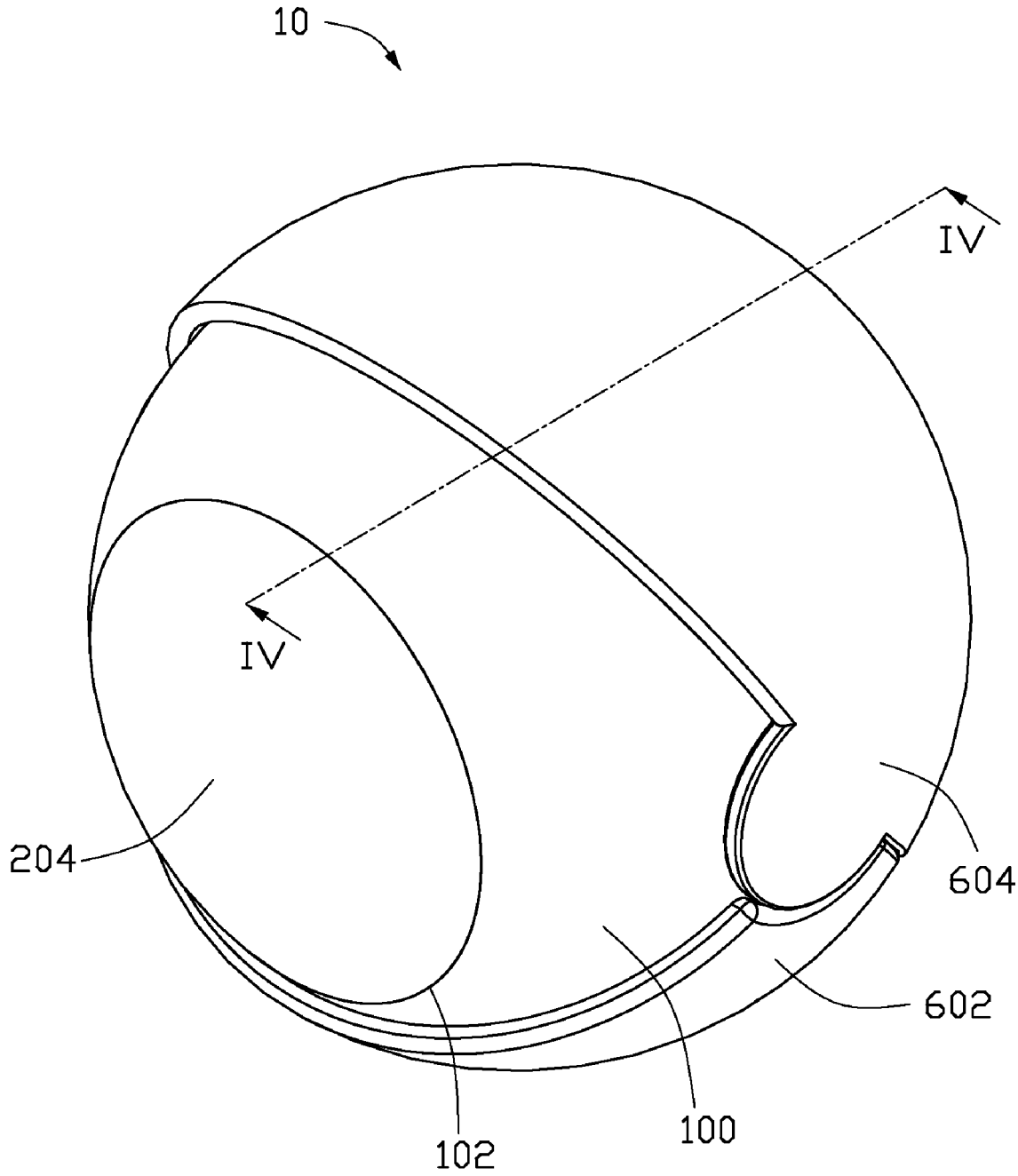
FIG. 1 is a perspective view of a simulated eye in accordance with one embodiment.

Referring to FIG. 1, a simulated eye 10 includes a semi-spherical eyeball 100, a translucent portion 204, a semi-spherical shell 602, and a simulated eyelid 604. The eyeball 100 is housed in the eyelid 604 and the shell 602. A circular transparent portion 102 is arranged at the front of the eyeball 100. The circular transparent portion 102 may be an opening. The simulated eyelid 604 is rotatably coupled to the shell 602 and can cover the eyeball 100. The translucent portion 204 is visible at the transparent portion 102 and is colored. In the embodiment, the translucent portion 204 is brown for simulating iris.

Figure 2:
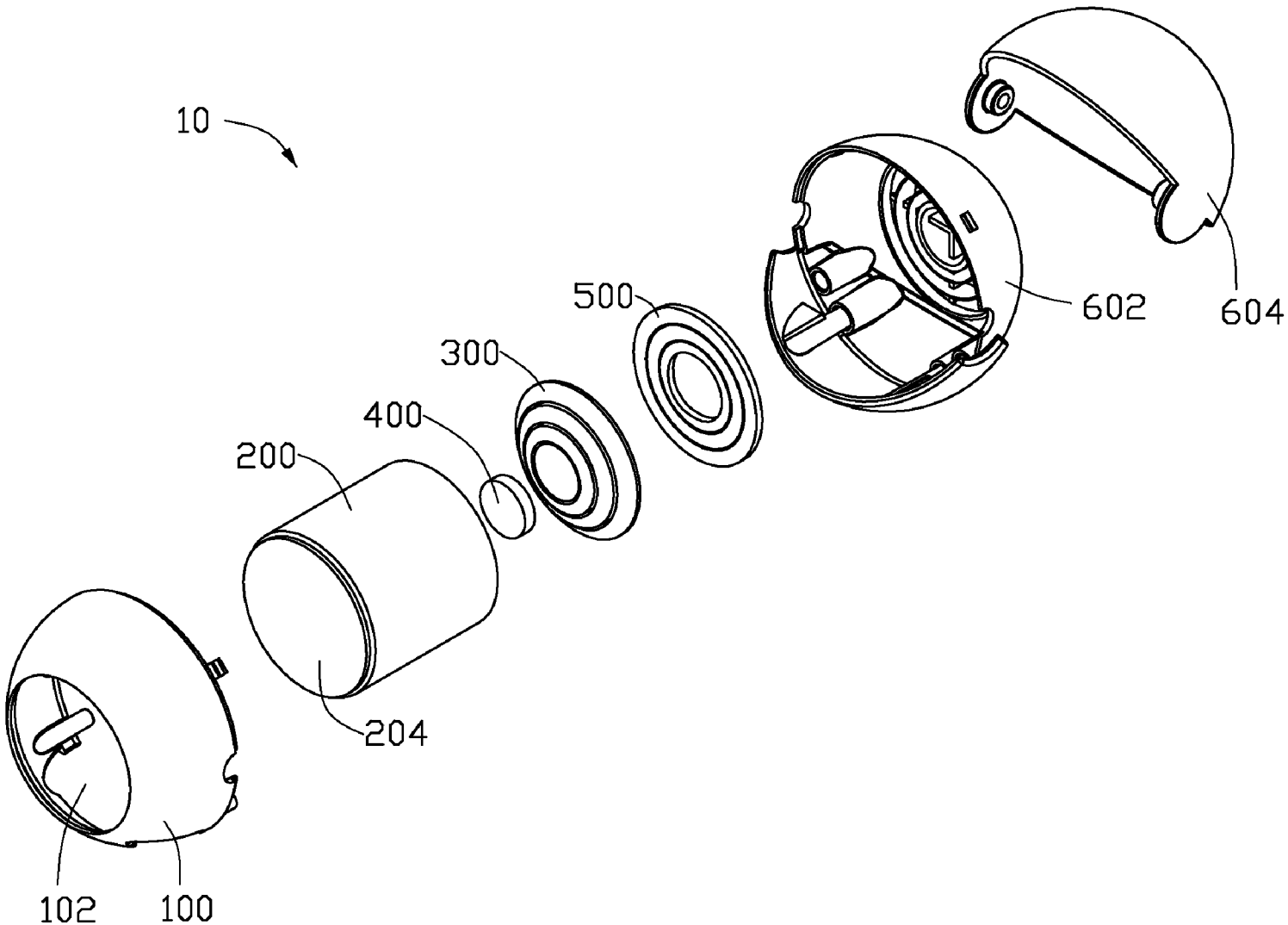
FIG. 2 is an exploded view of the simulated eye of FIG. 1.
Figure 3:
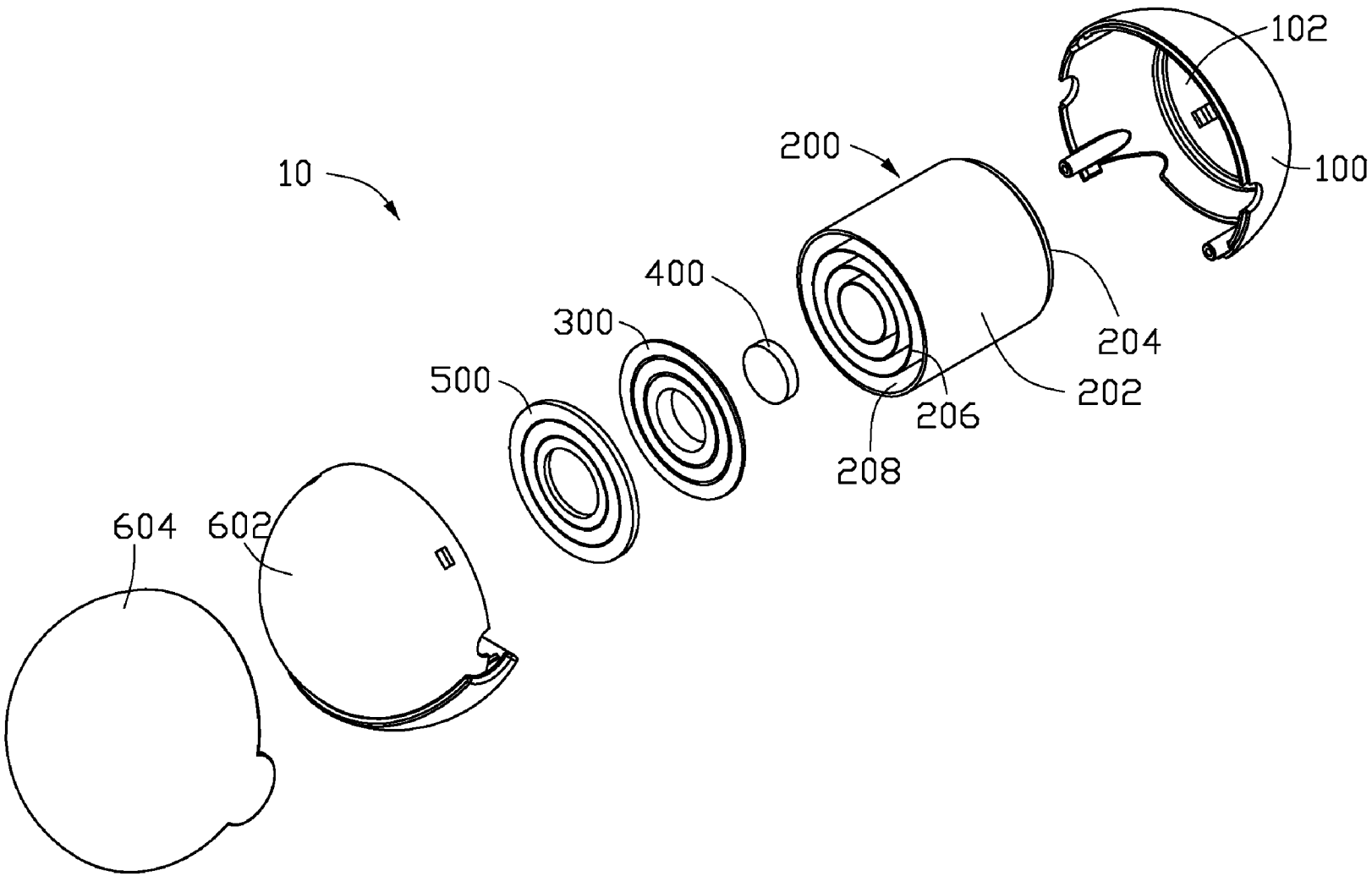
FIG. 3 is similar to FIG. 2, but viewed from another aspect.
Figure 4:
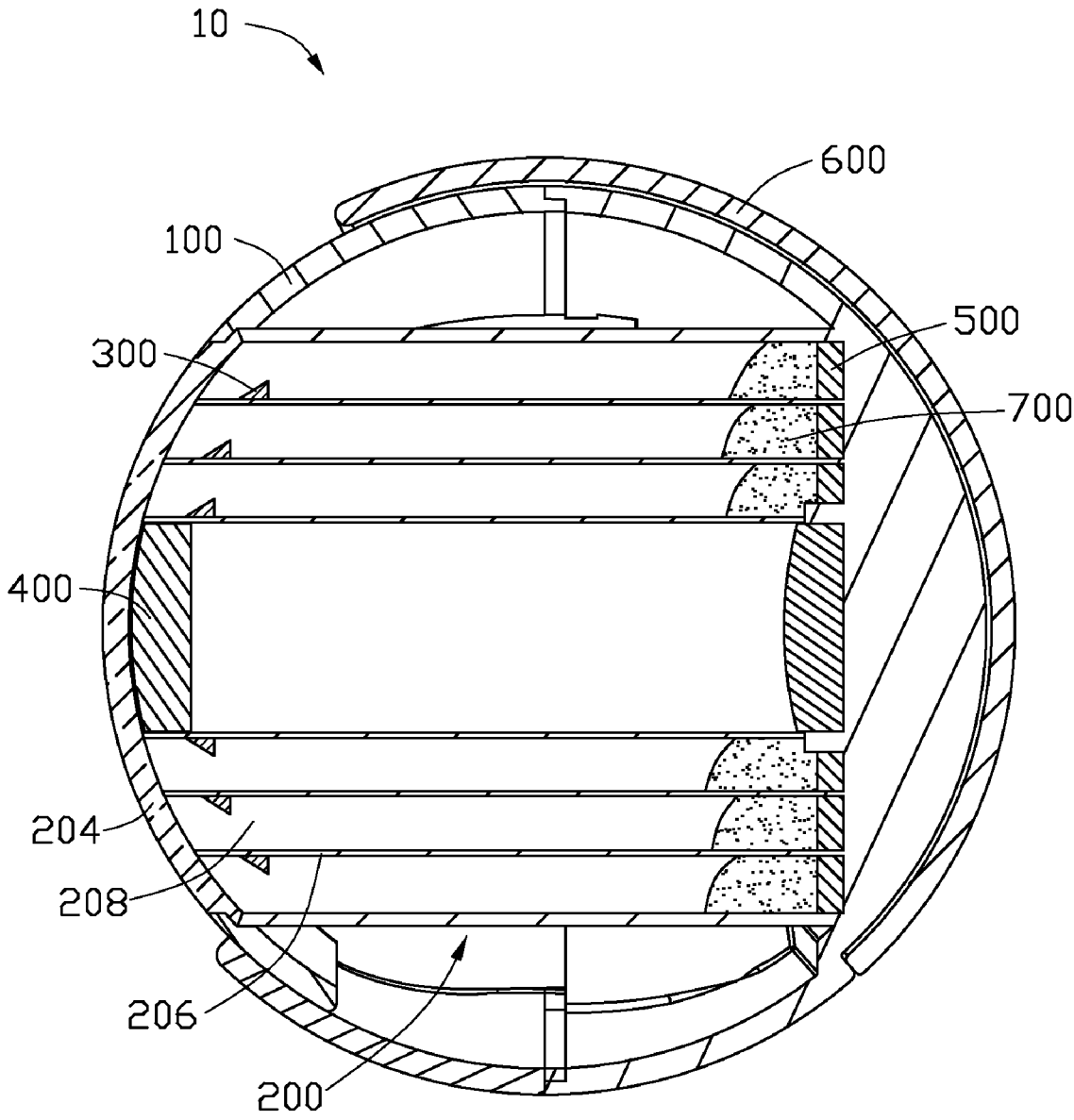
FIG. 4 is a cross-sectional view take along line IV-IV of FIG. 1 while the simulated eye is in a normal state.

Referring to FIGS. 2-4, the simulated eye 10 further includes a receiving member 200, three first electromagnets 300, a simulated pupil 400, three second electromagnets 500, and magnetic powder 700. A color of the magnetic powder is substantially similar to that of the simulated pupil 400.

The receiving member 200 includes a cylindrical portion 202, and the translucent portion 204. The cylindrical portion 202 includes four sleeves 206. The four sleeves 206 are coaxial and are attached to the translucent portion 204. Every two adjacent sleeves define a receiving space 208 for receiving some of the magnetic powder 700. The first electromagnets 300 and the second electromagnets 500 are placed and fixed at two opposite ends of the cylindrical portion 202. It should be noted that in assembly, the magnetic powder 700 is received in each receiving space 208, then the electromagnets 300, 500 are installed, effectively sealing the magnetic powder 700 in the receiving spaces 208.

The simulated pupil 400 is received in the innermost sleeve 206 and is attached tight to the translucent portion 204. Accordingly, the simulated pupil 400 is visible at the translucent portion 204. The color of the simulated pupil 400 is darker than that of the translucent portion 204. In the embodiment, the color of the simulated pupil 400 is black. The diameter of the simulated pupil 400 is substantially equal to that of the innermost sleeve 206.

Also referring to FIG. 4, the first electromagnets 300 are annular and are electrically connected to a power source (not shown) for supplying electric power. A cross-sectional view of each first electromagnet 300 is substantially similar to a triangle. A diameter of one first electromagnet 300 is larger than that of a sleeve 206 attached thereto, and is smaller than that of another sleeve 206 adjacent thereto.

The second electromagnets 500 are annular, and are electrically connected to a power source (not shown) for supplying electric power. A diameter of each of the second electromagnets 500 is substantially equal to that of the corresponding one of the sleeves 206.

The magnetic powder 700 in the receiving spaces 208 is movable between the first and second electromagnets 300, 500 when they are alternatively actuated for applying attractable magnetic force to the magnetic powder 700. The magnetic powder 700 is visible at the translucent portion 204 when a distance between the magnetic powder 700 and the translucent portion 204 is short enough; otherwise, the magnetic powder 700 is not visible. In the embodiment, when the distance is smaller than a predetermined value (e, g. 2 (mm)), the powder 700 can be visible; when the powder is at a distance greater than the predetermined value, the magnetic powder 700 is not visible. The number of the receiving spaces 208 is equal to that of the first and second electromagnets 300 and 500.

In assembly, the simulated pupil 400 is received in the innermost sleeve 206 and is attached to the translucent portion 204. The first electromagnets 300 are received in the corresponding receiving spaces 208 and are adjacent to the translucent portion 204, the slope surfaces 302 face the translucent portion 204. The first electromagnets 300 are located in a predetermined position, such that the first electromagnets 300 are not visible at the translucent portion 204. In the embodiment, the distance between the translucent portion 204 and each first electromagnet 300 is slightly larger than 2 mm. The magnetic powder 700 is received in each received space 206. The second electromagnets 500 are located away from the translucent portion 204, and are covered on the corresponding receiving spaces 206, such that the receiving spaces 206 are closed. The receiving member 200 engages with the opening 102 and is fixed to the shell 602. The simulated eyelid 604 is rotatably coupled to the shell 602 and can cover on the eyeball 100.

Figure 5:
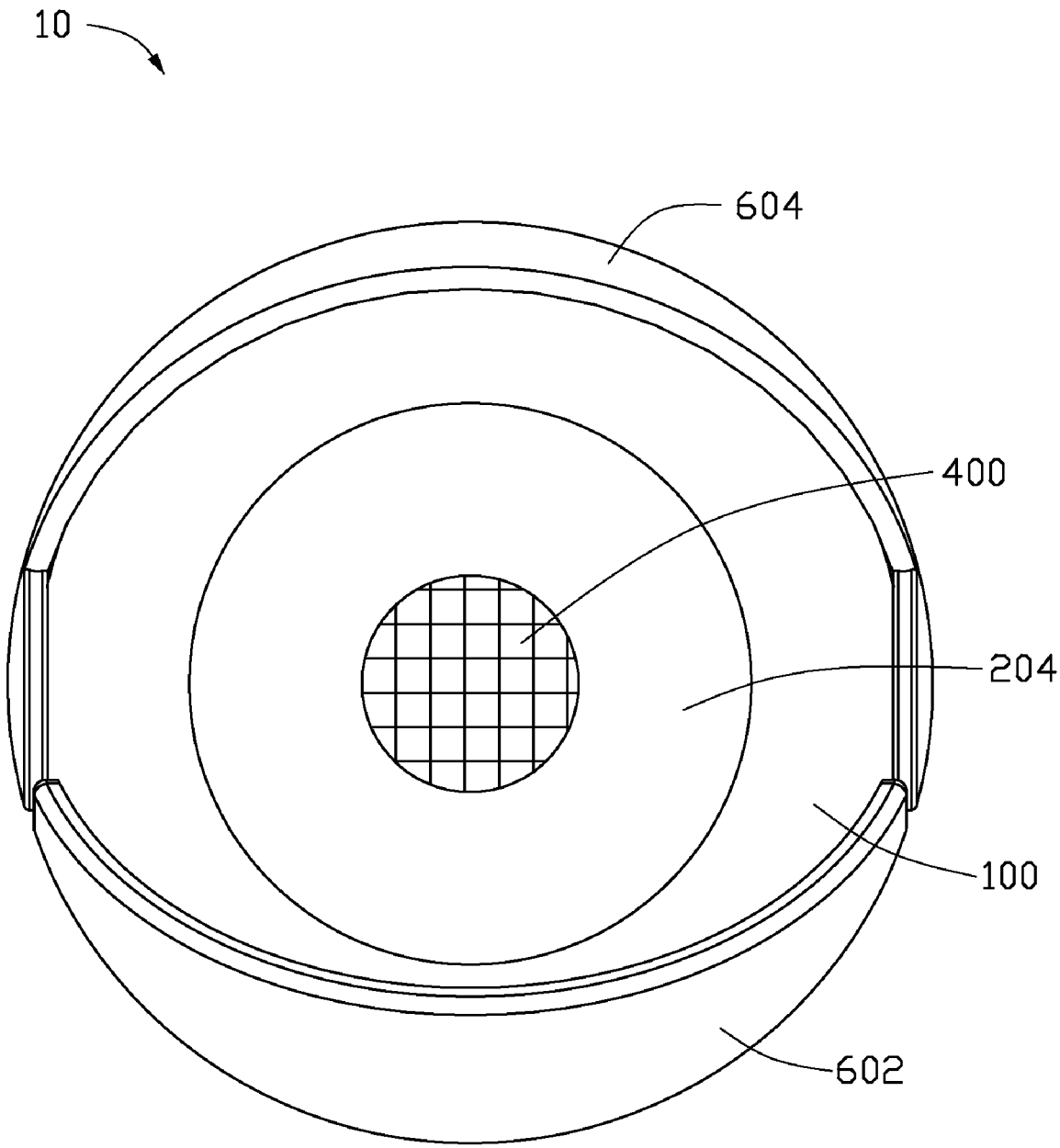
FIG. 5 is a perspective view of the simulated eye of FIG. 1 being in a normal state.

Referring to FIG. 5, after assembly, a black area representing the simulated pupil 400 is visible at the translucent portion 204. When the second electromagnets 500 are powered on, the magnetic powder 700 is magnetized, and attracted by the second electromagnets 500 to move away from the translucent portion 204. In this state, only the color of the simulated pupil 400 appears, the magnetic powder 700 is not visible, and the simulated eye 10 is said to be in a normal state.

Figure 6:
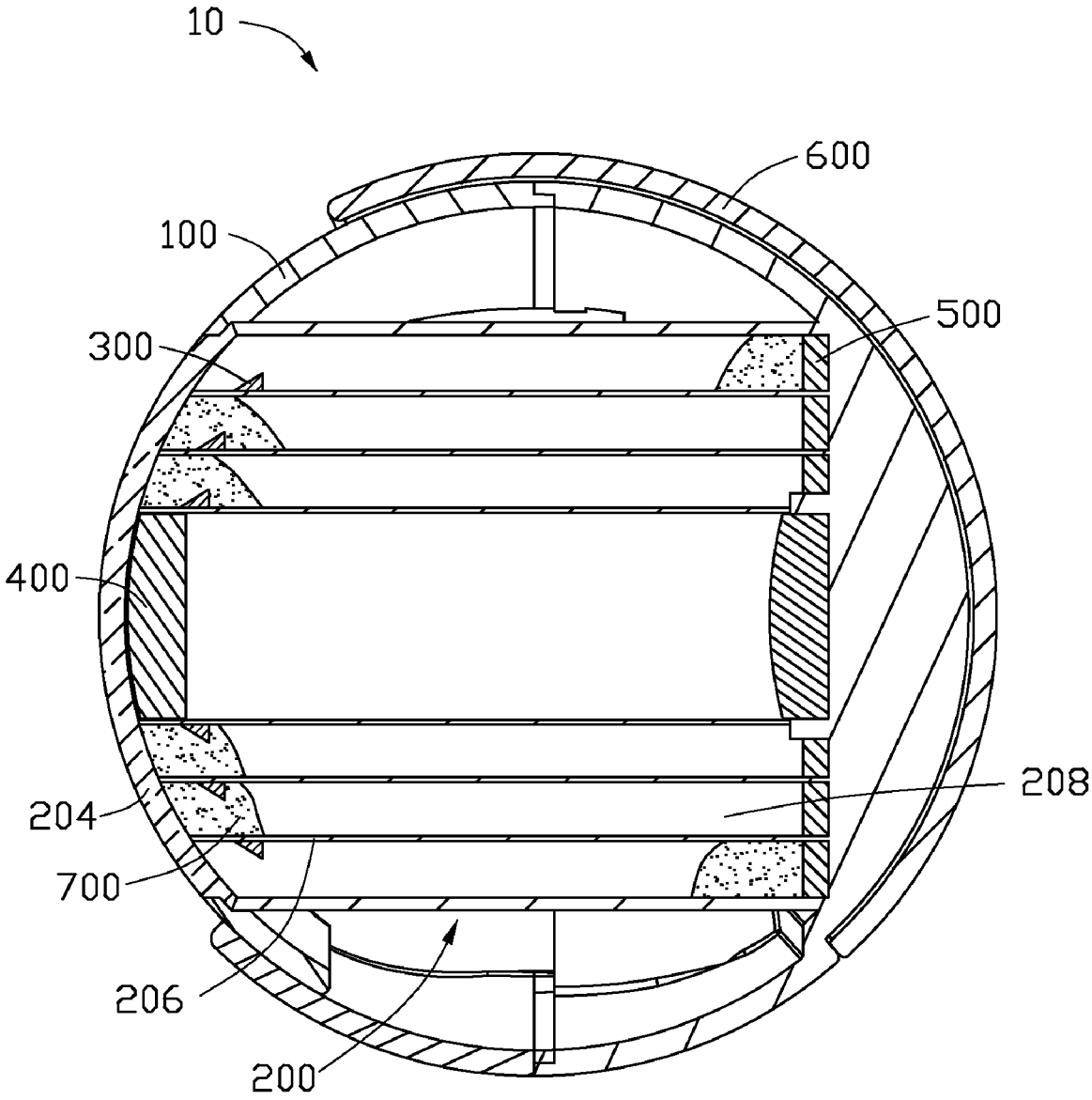
FIG. 6 is also a cross-sectional view take along line IV-IV of FIG. 1 while the simulated eye is in a dilated state.
Figure 7:
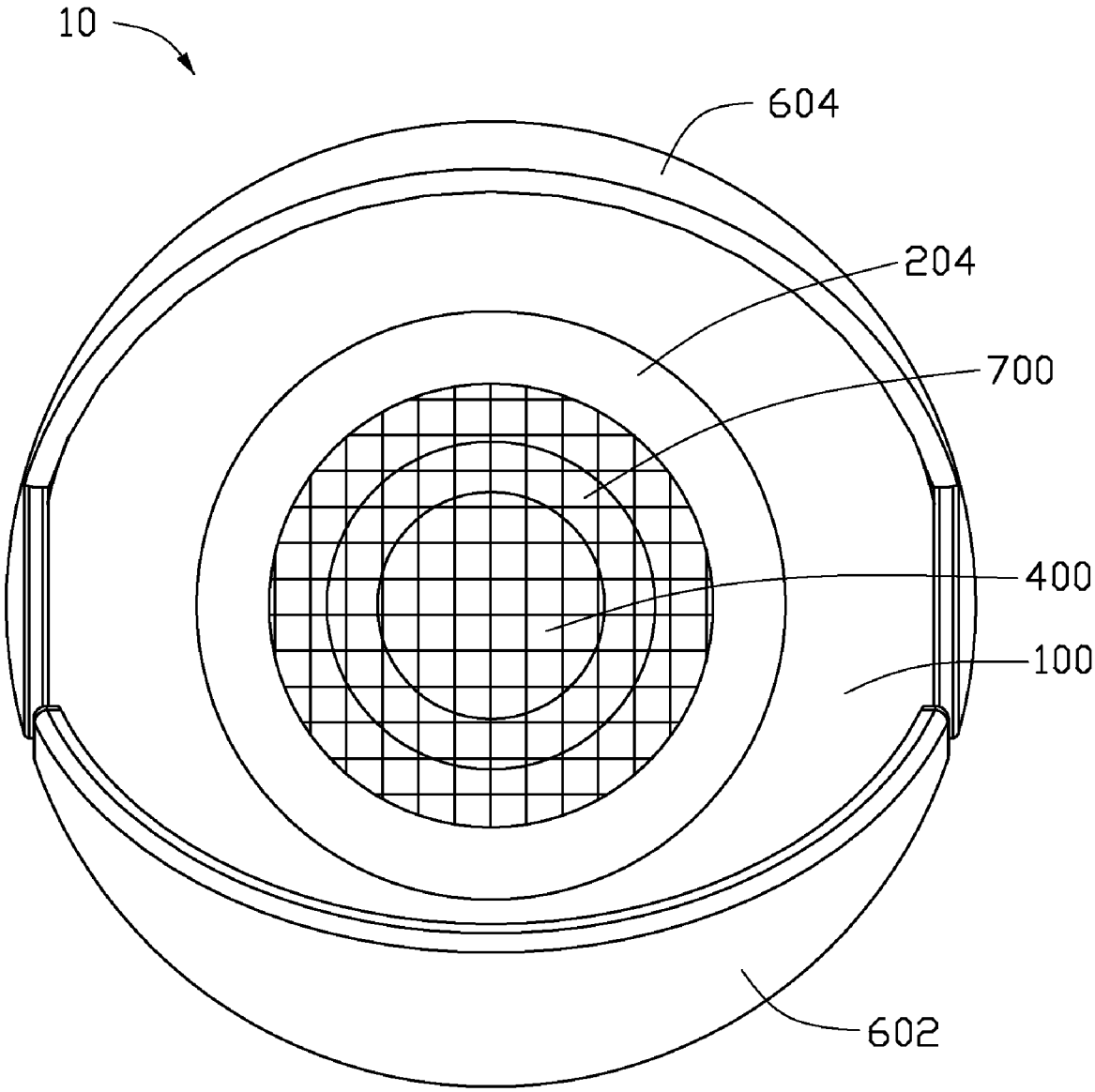
FIG. 7 is a perspective view of the simulated eye of FIG. 1 being in the dilated state.

Referring to FIGS. 6 and 7, when the first electromagnets 300 are powered on and the second electromagnets 500 are powered off, the magnetic powder 700 is attracted by the first electromagnets 300 to move toward the translucent portion 204, and are visible at the translucent portion 204. As the color of the magnetic powder 700 is substantially similar to that of the simulated pupil 400, thus, the size of the black area is enlarged. As a result, the simulated eye 10 seems to be dilated.

When the first electromagnets 300 are powered off, and the second electromagnets 500 are powered on, as the surface of the first electromagnet 300 is sloped, all the magnetic powder 700 is magnetized to move away from the translucent portion 204 by the second electromagnets 500. Accordingly, the size of the colored area returns to the original state. As a result, the simulated eye 10 is changed from the dilated state to the normal state.

Therefore, by operationally powering on and off the first and second electromagnets 300 and 500 to change the size of the color area appearing in the translucent portion 204, the simulated eye 10 is changeable between a normal state and a dilated state.

Furthermore, the first electromagnets 300 is selectable to being powered on in a sequence beginning with the first magnet adjacent to the coaxial axis A. Accordingly, when the first electromagnets 300 are selected to be powered on in the sequence, the size of the color area is gradually enlarged. As a result, the simulated eye 10 seems to be dilated gradually. In reverse, the simulated eye 10 is contracted gradually when the second electromagnets 500 are powered on and the first electromagnets 300 are selected to be powered off in sequence. In other embodiments, the number of the sleeves 206 may be different.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A simulated eye, comprising:

an eyeball;

a receiving member comprising a translucent portion and a cylindrical portion, wherein the cylindrical portion comprises at least two sleeves, the at least two sleeves received in the cylindrical portion are fixed to the translucent portion and are coaxial;

a simulated pupil received in an innermost one of the at least two sleeves and is attached to the translucent portion;

at least one first electromagnet, wherein the at least one first electromagnet is received between every two of the at least two sleeves and is adjacent to the translucent portion;

at least one second electromagnet, wherein the at least one second electromagnet is fixed to the cylindrical portion; and magnetic powder;

wherein the magnetic powder is magnetized to move to the translucent portion when the at least one first electromagnet is powered on and the at least one second electromagnet is powered off; and wherein the magnetic powder is magnetized to move away from the translucent portion when the at least one first electromagnet is powered off and the at least one second electromagnet is powered on.

2. The simulated eye of claim 1, wherein the eyeball comprises a transparent portion, and the translucent portion is visible at the transparent portion.

3. The simulated eye of claim 1, wherein the simulated pupil is visible at the translucent portion, and a color of the simulated pupil is darker than that of the translucent portion.

4. The simulated eye of claim 1, wherein a receiving space for receiving one of the at least one first electromagnet is formed between every two adjacent sleeves of the at least two sleeves and the at least one second electromagnet closes the at least one receiving space formed by the at least two sleeves.

5. The simulated eye of claim 1, wherein a color of the magnetic powder is substantially similar to that of the simulated pupil.

6. The simulated eye of claim 1, wherein the at least one first electromagnet is annular and comprises a sloped surface.

7. A simulated eye capable of being operated between a normal state and a dilated state, the simulated eye comprising:

a semispherical eyeball;

a receiving member comprising a translucent portion and a cylindrical portion;

at least one first electromagnet received in the cylindrical portion and adjacent to the translucent portion;

at least one second electromagnet fixed to the cylindrical portion, wherein the at least one second electromagnet and the translucent portion close the cylindrical portion to form a closed receiving space; and magnetic powder received in the closed receiving space;

wherein when the at least one first and at least one second electromagnet are operational to move the magnetic powder toward and away from the translucent portion, a size of a color area of the translucent portion is changeable, whereby the simulated eye is changed between the normal state and the dilated state.

8. The simulated eye of claim 7, further comprising a simulated pupil received in the cylindrical portion and attached to the translucent portion.

9. The simulated eye of claim 8, wherein the simulated pupil is visible at the translucent portion, and a color of the simulated pupil is darker than that of the translucent portion.

10. The simulated eye of claim 8, wherein a color of the simulated pupil is similar to that of the magnetic powder.

11. The simulated eye of claim 7, further comprising a semispherical shell that the eyeball is housed in.

12. The simulated eye of claim 11, further comprising a simulated eyelid, wherein the simulated eyelid covers the eyeball and is rotatably coupled thereto.

13. The simulated eye of claim 7, wherein the eyeball comprises a transparent portion, and the translucent portion is visible at the transparent portion.

* * * * *